United States Patent [19]

Geiger

[11] Patent Number: 4,458,819

[45] Date of Patent: Jul. 10, 1984

[54] SEAL FOR CONTAINER SAFETY PLUG

[75] Inventor: Albert Geiger, Garmisch-Partenkirchen, Fed. Rep. of Germany

[73] Assignee: Geiger Plastic GmbH, Fed. Rep. of Germany

[21] Appl. No.: 495,994

[22] Filed: May 19, 1983

[30] Foreign Application Priority Data

May 27, 1982 [EP] European Pat. Off. ..... 82710034.8

[51] Int. Cl.[3] ..... B65D 55/02

[52] U.S. Cl. ..... 215/224; 215/299

[58] Field of Search ..... 215/201, 211, 213, 215, 215/224, 225, 299, 233, 296

[56] References Cited

U.S. PATENT DOCUMENTS 4,098,417 7/1978 Bennett .
4,098,418 7/1978 Fields .
4,146,146 3/1979 Mar .
4,358,022 11/1982 Geiger ..... 215/224

*Primary Examiner*—George T. Hall
*Attorney, Agent, or Firm*—Stephen F. K. Yee

[57] ABSTRACT

A removal-resistant plug or closure for a container has a slide radially extensible beyond the circumference of the plug and container to provide a gripping surface for removal of the plug. With the slide retracted, the exterior surfaces of the plug is smooth and devoid of any gripping surface. A seal attached after the container is filled and the plug inserted is provided by a cavity which extends across a lateral edge of the slide and the adjacent portion of the slide guide in the plug. A marker plate is attached to cover the cavity such that when the slide is moved, the portions of the cavity are misaligned to break the marker plate from the plug to provide a visible indication that the seal has been broken.

6 Claims, 4 Drawing Figures

SEAL FOR CONTAINER SAFETY PLUG

The invention concerns so-called "child-proof" or "safety" plugs, i.e., plugs which are protected against improper opening and which are used in connection with containers whose contents are dangerous, especially to children, and primarily containers for medications, such as tablets and sugar-coated pills.

The invention employs a container and safety plug therefor resembling that disclosed in the applicant's U.S. Pat. No. 4,358,022 (DE No. 30 19 180 A1), in which the part of the plug projecting above the container rim is conically tapered and thus does not provide a surface by which the container or plug can be seized to remove the plug. To make removal of the plug possible, a slide, moving in lateral grooves, is provided in the upper part of the plug. When placed in the inserted or closed position, the slide does not project beyond the outer peripheral contours of the plug and its exterior surface is more or less flush with the exterior surface of the plug. At the same time, the slide can be slid out radially to extend over the container rim to provide a grasping surface for the removal of the plug.

In the pharmaceutical industry there is a need, which in some countries also represents a requirement, to seal the containers in such a way that it can be seen whether the container has been opened after sealing by the manufacturer, i.e., there is a requirement that the container have a so-called original seal.

The objective of the invention is to meet this requirement in a simple fashion, while employing a child-proof plug of the type described in U.S. Pat. No. 4,358,022 (DE No. 30 19 180 A1), that is, to create a child-proof plug with an original seal.

The invention achieves this objective by means of a cavity or recess which is molded or otherwise formed in the upper surface of a safety plug, adjacent to one lateral side of the slide and the adjacent bordering surface of the plug, such that half of the recess is in the slide and the remaining half is in the plug, and into which a marking or indicating plate or disk is attached in such a way that it can break off, such as by means of plastic welding or with an adhesive.

Preferably this cavity has a spherical form, and the surface of the marking plate, which preferably has a color conspicuously different from that of the slide and plug, can be recessed lower in relation to the common upper surfaces of the slide and the plug.

In the following the invention is described in relation to the drawings in which.

Figure 1:
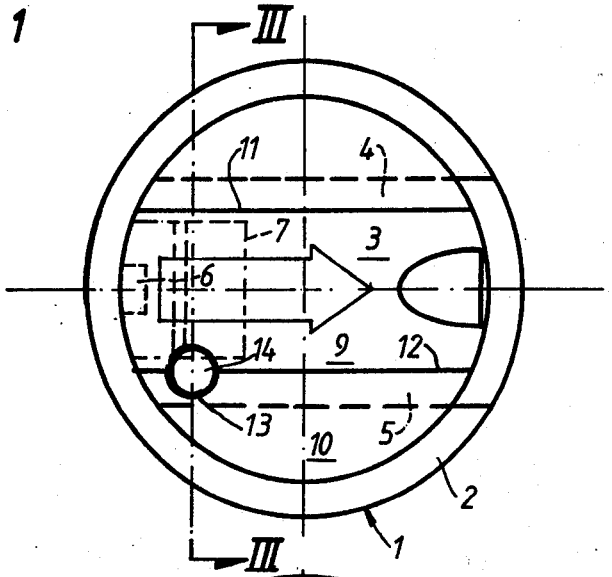
FIG. 1 is a top view of a plug with inserted slide and marker plate in place.
Figure 2:
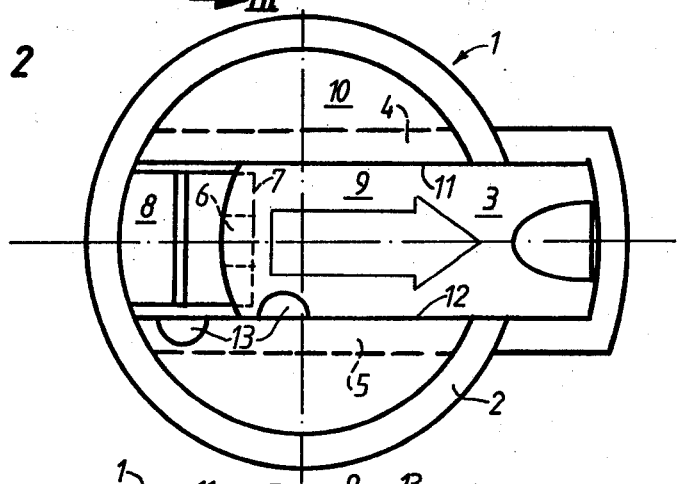
FIG. 2 is the plug of FIG. 1, with the slide in a non-inserted position.
Figure 3:
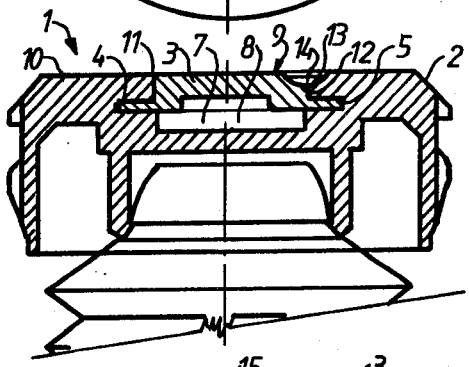
FIG. 3 is a section along line III—III of FIG. 1.

The upper, projecting surface of plug 1, as shown in FIGS. 1-3, tapers conically toward the container rim (shown in broken lines) to form a sloped smooth surface 2 which does not provide a gripping surface to remove the plug from the container. Plug removal is achieved with a slide 3, which moves in recessed lateral grooves 4 and 5 in the plug 1 and which, in the inserted or closed position, does not project beyond the outer peripheral contours of the plug or the container. At the same time, the slide 3 can be shifted to one side, as shown in FIG. 2, so that one end projects beyond the container rim, thus forming a handle for removing the plug 1 from the container.

A catch 6 projects downwardly from the inner lower surface of the slide 3 and, when the slide is laterally displaced, comes into contact with a step 7 found in a recess 8 in the slide guide, thus making it impossible to draw the slide out completely from the plug 1.

As shown clearly in FIG. 3, the upper surface 9 of the slide 3 is flush with the upper surface 10 of the plug 1.

The safety plug and container are disclosed in U.S. Pat. No. 4,358,022.

To provide the child-proof plug of this kind with an original seal, a cavity 13, which is of uniform configuration when the slide 3 is in the inserted position, is molded into both surfaces 9 and 10, on both sides of one of the lateral borders 11 or 12 between the lateral surface of the slide and the adjoining lateral surface of the slide guide. The cavity 13 extends across the adjoining lateral surfaces of the slide 3 and plug 1 so that one half of the cavity is formed in the slide and one half of the cavity is formed in the adjacent portion of the plug. The cavity 13 has a spherical shape, and a marking plate or disk 14 of circular shape is attached within it, e.g. by means of thermo-welding or with a brittle adhesive, in such a way that the plate can break off when the slide 3 is extended. The marking plate 14, when applied during the container-filling process, serves as a seal to indicate that the safety plug 1 has not been opened after the container has been sealed.

When the slide 3 is moved from the inserted or closed position shown in FIG. 1, which it assumes when the seal is initially attached to the filled container in a packing machine, to the extended position shown in FIG. 2, which enables the plug to be removed, the two parts of the cavity 13 are moved away from each other and the marking plate 14 within the cavity is broken off, an action that is facilitated by the spherical form of the cavity, which extends up to the rims of the plug.

If, after the needed quantity of content is removed from the container, the slide 3 is repositioned in the position shown in FIG. 1 to prevent children from removing the plug 1, the absence of the marking plate 14 indicates that the container has already been opened.

To prevent the unintentional detachment of the marking plate 14 from the cavity 13, it is advantageous to lower or recess its upper surface in relation to the upper surface 9 of the slide 3 and upper surface 10 of the plug 1. The intact condition of the seal is clearly identifiable when the marking plate 14 has a noticeably different color from that of the slide 3 and the plug 1. Like the plug 1 and the slide 3, the marking plate 14 is preferably made of a thermoplastic synthetic material.

Figure 4:
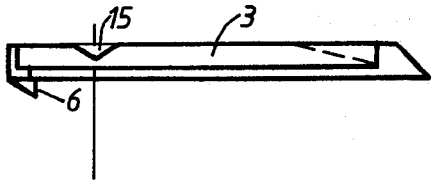
FIG. 4 is a side view of a slide with a modified cavity.

FIG. 4 is a side view of the slide 3, in which a cavity 15 does not have a spherical form, but rather that of a wedge, rising in a straight line from the lowest point to the front and back rim. Naturally the longitudinal section of the cavity 13 (FIGS. 1 and 2) or 15 (FIG. 3) can have other shapes, just as it is not necessary for the cavity to be circular, in horizontal section, as it is in the top view shown in FIGS. 1 and 2. It can be a wedge-shaped cross section, as shown in FIG. 4, or it can have an oval, square, rectangular or polygonal shape.

I claim:

1. A removal-resistant closure for application to a container to close the container opening, said closure having a slidable removal assisting member adapted to be displaced from a first position wherein said member is positioned within the peripheral confines of said closure, to a second position wherein a portion of said member extends beyond the periphery of said closure to provide a surface against which a force may be applied to remove said closure, said closure having a seal comprising:

a cavity in an upper surface of said closure, said cavity extending across a lateral portion of said member and a portion of said closure such that a portion of said cavity is in said member and the complementary portion of said cavity is in said closure; and a cover for said cavity, the horizontal planar shape of said cover corresponding to the horizontal planar shape of said cavity, said cover being attached within said cavity such that movement of said slidable member breaks said cover from said cavity.

2. A closure as defined in claim 1, wherein with said slidable member in said first position, the portion of said cavity in said member aligns with the portion of said cavity in the plug to form a cavity of substantially uniform configuration.

3. A closure as defined in claim 2, wherein said cavity has a concave surface of substantially spherical configuration.

4. A closure as defined in claim 1, wherein the upper, exterior surface of said cover is recessed below the surface of said member and said closure.

5. A closure as defined in claim 1, wherein the exterior surface of said cover is of a color different from that of said member and said closure.

6. A closure as defined in claim 1, further comprising stop means on said closure and coacting means on said slidable member cooperating with said stop means to prevent removal of said member from said closure.

* * * * *